US008992070B2

(12) United States Patent
Kandiyeli et al.

(10) Patent No.: US 8,992,070 B2
(45) Date of Patent: Mar. 31, 2015

(54) METHOD AND APPARATUS FOR BLENDING PROCESS MATERIALS

(71) Applicant: Mega Fluid Systems, Inc., Tualatin, OR (US)

(72) Inventors: David D. Kandiyeli, Mesa, AZ (US); Quay Issac Gene Williams, Sandy, OR (US); Barry K. Cavinaw, Wilsonville, OR (US); Charles R. Boley, Canby, OR (US)

(73) Assignee: Mega Fluid Systems, Inc., Tualatin, OR (US)

( * ) Notice: Subject to any disclaimer, the term of this patent is extended or adjusted under 35 U.S.C. 154(b) by 0 days.

(21) Appl. No.: 14/104,818

(22) Filed: Dec. 12, 2013

(65) Prior Publication Data

US 2014/0098628 A1 Apr. 10, 2014

Related U.S. Application Data

(62) Division of application No. 12/764,086, filed on Apr. 20, 2010.

(60) Provisional application No. 61/214,139, filed on Apr. 20, 2009.

(51) Int. Cl.

| | |
|---|---|
| ***B01F 5/24*** | (2006.01) |
| ***B01F 15/02*** | (2006.01) |
| ***B01F 3/12*** | (2006.01) |
| ***B01F 5/00*** | (2006.01) |

(52) U.S. Cl.

CPC ..... *B01F 15/0227* (2013.01); *B01F 3/1271* (2013.01); *B01F 5/248* (2013.01); *B01F 5/0057* (2013.01)

USPC ..... 366/136; 366/165.1

(58) Field of Classification Search

CPC ..... B01F 5/248

USPC ..... 366/136, 137, 137.1, 165.1

See application file for complete search history.

(56) References Cited

U.S. PATENT DOCUMENTS

| | | | | | |
|---|---|---|---|---|---|
| 1,947,851 | A | * | 2/1934 | Jewett | 366/136 |
| 2,125,274 | A | | 8/1938 | Gilbert | |
| 2,224,355 | A | * | 12/1940 | Moller | 106/206.1 |
| 2,413,375 | A | | 12/1946 | Pomeroy | |
| 2,461,746 | A | | 2/1949 | Lathrop et al. | |
| 3,029,069 | A | | 4/1962 | Cummings | |
| 3,212,757 | A | * | 10/1965 | Martin et al. | 366/165.2 |
| 3,257,174 | A | | 6/1966 | Fournel | |
| 3,606,093 | A | * | 9/1971 | Morse et al. | 222/145.7 |
| 3,816,427 | A | * | 6/1974 | Loliger et al. | 422/278 |

(Continued)

*Primary Examiner* — David Sorkin

(74) *Attorney, Agent, or Firm* — Heslin Rothenberg Farley & Mesiti P.C.

(57) ABSTRACT

An improved method and apparatus for blending process materials. Preferred embodiments of the present invention are directed to a process material contacting system to increase wetted surface area for liquid contact as well as increase forced convective mixing efficiency of the liquid mixture. Use of a novel process material contacting apparatus allows one solid feeding element to serve multiple process material tanks, thus reducing overall system costs and decreasing set-up time/process variability while increasing operational efficiency. According to a preferred embodiment of the present invention, rather than adding a process material to a volume of liquid held in a blending tank, the added process material is remotely blended with the liquid outside the process material tank.

11 Claims, 10 Drawing Sheets

(56) References Cited

U.S. PATENT DOCUMENTS

| | | | | | |
|---|---|---|---|---|---|
| 4,426,156 | A | * | 1/1984 | Adamo et al. | 366/156.1 |
| 4,475,817 | A | * | 10/1984 | Brunt | 366/3 |
| 4,701,055 | A | | 10/1987 | Anderson | |
| 6,109,778 | A | | 8/2000 | Wilmer | |
| 6,536,468 | B1 | | 3/2003 | Wilmer et al. | |
| 6,923,568 | B2 | | 8/2005 | Wilmer et al. | |
| 7,344,298 | B2 | | 3/2008 | Wilmer et al. | |
| 8,119,207 | B2 | | 2/2012 | Rigaudon et al. | |
| 2005/0219938 | A1 | | 10/2005 | Rigaudon et al. | |
| 2008/0062813 | A1 | | 3/2008 | Wilmer et al. | |

* cited by examiner

METHOD AND APPARATUS FOR BLENDING PROCESS MATERIALS

CROSS-REFERENCE TO RELATED APPLICATIONS

This application is a divisional application of U.S. application Ser. No. 12/764,086 filed Apr. 20, 2010, which claims priority to U.S. Provisional Application No. 61/214,139 filed Apr. 20, 2009, each of which are hereby incorporated herein by reference in their entireties.

TECHNICAL FIELD OF THE INVENTION

The present invention is directed to a method and apparatus for blending process materials, more particularly to a process material contacting system to increase wetted surface area for liquid contact as well as increase forced convective mixing efficiency of the liquid mixture.

BACKGROUND OF THE INVENTION

Bulk delivery systems are used, for example, to supply process equipment in the pharmaceutical, cosmetic, and semiconductor industries with blended process materials such as liquid chemicals or slurries. In the semiconductor industry, blended process materials are typically prepared using batch production systems including a blending subsystem and a distribution subsystem. In the blending subsystem, process materials are added to a blending vessel or tank. For example, the process materials might consist of a solid material, such as a dry powder containing abrasives or chemical compounds, and a liquid, such as deionized (DI) water.

Many conventional processes require precise addition of process materials to produce a batch of blended process materials that is acceptable for its intended application. Accordingly, the measuring instruments that monitor the inputs to the blending tank are typically very precise to insure batch-to-batch consistency. In many applications, even minor process variations may lead to significant differences in the batch of blended process materials, potentially rendering it useless for its intended application.

FIG. 1A shows a typical prior art arrangement of a solids blending subsystem 100 for mixing a process material. Solid feeder 10 holds a supply of dry solid material in a hopper 11. The dry material is moved from the Solid feeder to blending tank 12 by using a feed screw mechanism. The amount of solid material added to the blending tank 12 may be controlled via a loss-in-weight mechanism 13. The solid feeding element makes use of a very accurate scale to determine when the precise amount of dry material has been fed into the blending tank based upon the weight of the material remaining in the hopper of the solid feeding element 10. The solid material is often mixed with a liquid in the blending tank 12 via an impeller or mixer 14 to form a homogeneous batch of blended process materials. Tank may also include an agitator, such as an impeller or a sparger head 15, particularly where the process materials may settle or separate.

Once the process materials have been adequately mixed, the process material is typically transferred through the material supply lines to the distribution subsystem 102, shown in FIG. 1B. The blended process material is first pumped to a distribution tank 22, commonly referred to as a day tank. The process material can then be distributed via a distribution pump 27 from the day tank 22 through the global loop 24, 25 to the final points of use 28 for its intended application. Points of use may be any location where there is demand for a supply of the blended process material. For example, points of use may include process machinery or work stations in a semiconducting fabrication facility.

As also shown in FIG. 1A, the process material can be pumped from the blending tank to the distribution tank by dual diaphragm pump 17, although other types of pumps could also be used. A typical bulk delivery system may also a process control system including flow control devices or sensors positioned on the material supply lines 16 and a controller comprising logic code to provide a control signal to the flow control devices based upon sensor signals (not shown). The movement of process material through the material supply lines can be controlled by a variety of known flow control devices, including manual valves 18, automatic diaphragm valves 19, or three-way valves 20 (which also allow air to be vented from the system). In some cases, a pulsation dampener 21 may be employed to smooth the pressure in the lines resulting from the transfer pump 17.

Prior art bulk material delivery systems are described, for example, in U.S. Pat. No. 7,344,298 to Wilmer et al. for "Method and Apparatus for Blending Process Materials" (Mar. 18, 2008) and in U.S. Pat. No. 6,923,568 to Wilmer et al. for "Method and Apparatus for Blending Process Materials" (Aug. 2, 2008), both of which are incorporated herein by reference.

There are a number of disadvantages to this type of prior art bulk delivery system. First, the blending process itself suffers from some inherent inefficiency. Significantly, as the solid material from the solid feeding element is added to the liquid in the blending tank, the contact area for wetting the added solid material is limited to the surface of the liquid in the tank. This slows the rate at which solid material can be added to the tank. The localized forced-convection mixing of the solids into the liquid in a prior art system can also be relatively inefficient for fine, hydrophobic solids, due in part to the tendency of some solid materials to float on the surface of the liquid rather than being entrained into the circulating liquid in the blending tank.

Also, where only one blending tank and one distribution tank are employed, it is often necessary to "spike" the mixture with either solids or liquids at the distribution tank to maintain product character while the blending system is producing another batch. For this reason, it is more desirable to use multiple solids feeders. The solid feeder is quite expensive when compared to the other components, and the prior art system requires a solid feeder for each process material tank used for blending or mixing. The cost associated with a solid feeder thus increases in one-to-one multiples with the number of active blending tanks and distribution tanks if spiking functions are present. Further, where multiple blending tanks are employed separate set-up is required to tune each solid feeding element to achieve batch-to-batch reproducibility within a given system.

What is needed is an improved method and apparatus for process material blending that provides an increased wetted surface area for liquid contact as well as increase forced convective mixing efficiency of the mixture. What is also needed is an improved apparatus that allows one solid feeder to serve multiple tanks to reduce overall costs and increase operational efficiency.

SUMMARY OF THE INVENTION

An object of the present invention is to provide an improved apparatus for process material blending that provides a larger contact area for wetting added process material, thus improving mixing efficiency. An object of the present invention is also to reduce overall system cost by allowing a single solid feeder to be used with multiple process material tanks.

Preferred embodiments of the present invention include a process material contactor which uses a falling liquid column to provide continuously changing contact surface between the liquid and added process material—which is typically a dry powdered solid—thereby increasing the available wetting surface area without increasing the dimensions of the static contact surface, while also increasing the forced convective mixing efficiency of the mixture. A process material contactor according to the present invention also allows remote blending of the process materials before the blended liquid is transferred to a process material tank. Preferred embodiments of the present invention also provide for adjustment of wetted surface area, decreased set-up time and process variability, a reduction in overall system cost, and closed loop control of solid/liquid spiking at a combined lend/distribution tank.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

The accompanying drawings are not intended to be drawn to scale. In the drawings, each identical or nearly identical component that is illustrated in various figures is represented by a like numeral. For purposes of clarity, not every component is labeled in every drawing.

DETAILED DESCRIPTION FOR CARRYING OUT THE INVENTION

Preferred embodiments of the present invention are directed to a process material contacting system to increase wetted surface area for liquid contact as well as increase forced convective mixing efficiency of the liquid mixture. Use of the novel process material contacting apparatus described herein also allows one solid feeding element to serve multiple process material tanks, thus reducing overall system costs and decreasing set-up time/process variability while increasing operational efficiency. According to a preferred embodiment of the present invention, rather than adding a process material to a volume of liquid held in a blending tank, the added process material is remotely blended with the liquid outside the process material tank.

Figure 2A:
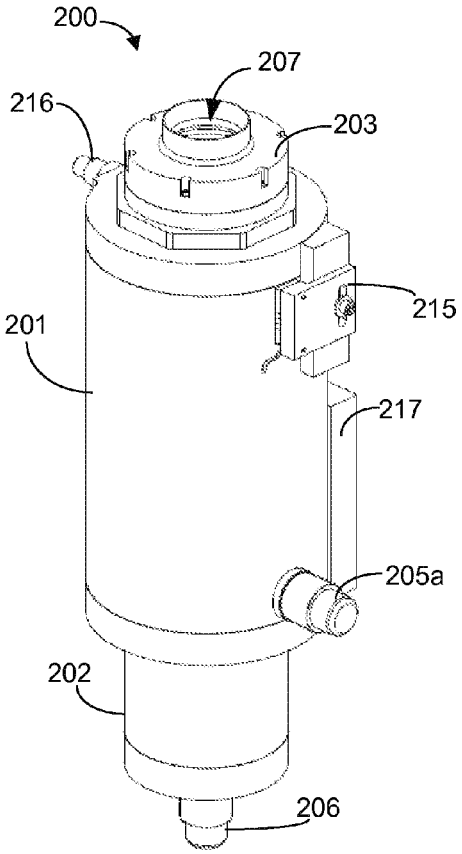
FIGS. 2A-2B show perspective views of solid-liquid contactor according to a preferred embodiment of the present invention.
Figure 2B:
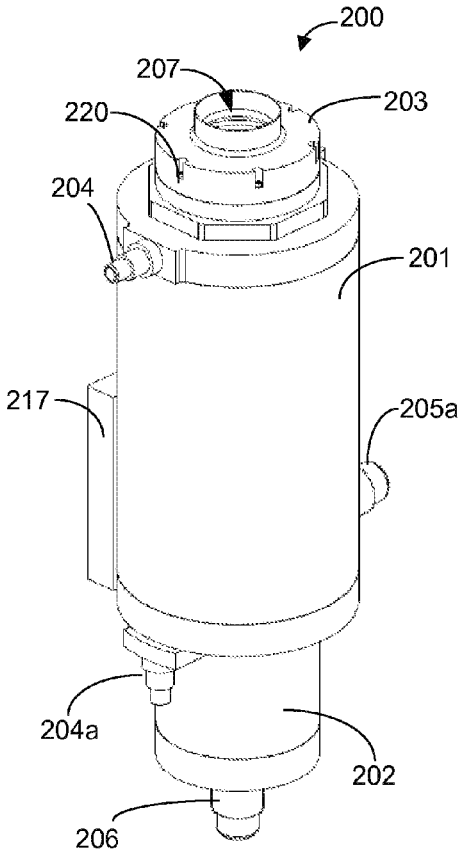
Figure 3:
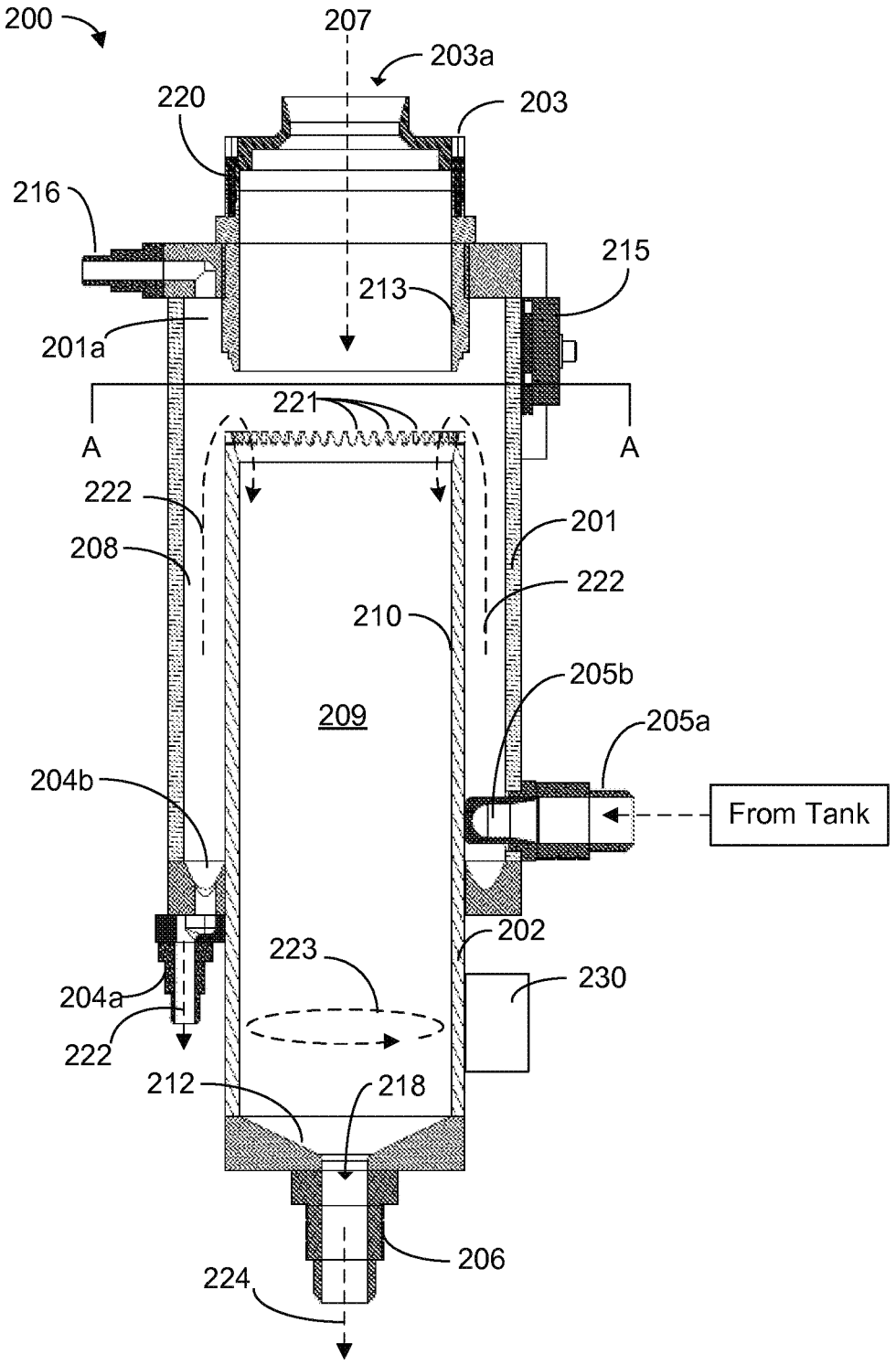
FIG. 3 shows a vertical cross-sectional view of the solid-liquid contactor of FIGS. 2A-2B.
Figure 4:
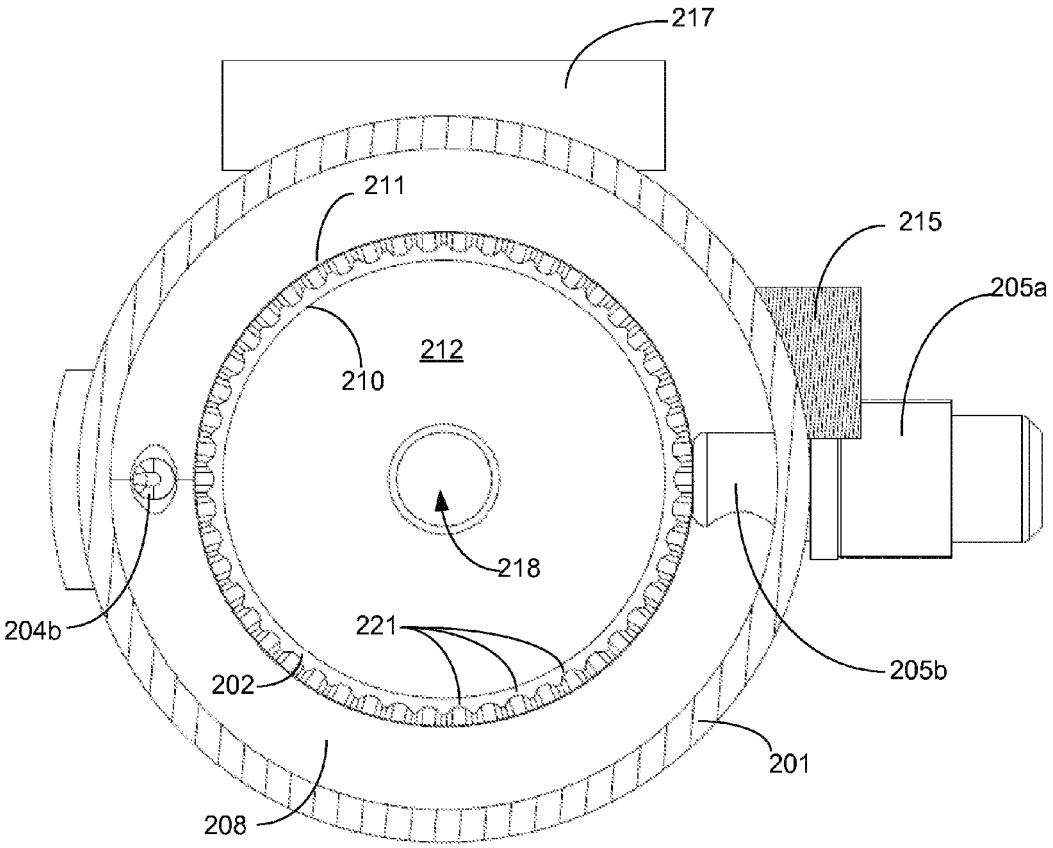
FIG. 4 shows a top down cross-sectional view of the solid-liquid contactor of FIGS. 2A-2B.

One preferred embodiment of a process material blending apparatus according to the present invention is shown in FIGS. 2-4. The blending apparatus of FIGS. 2-4 can be referred to as a solid-liquid contactor ("SLC"). The SLC includes a falling liquid column that greatly expands the surface area for contact between the liquid and added solid materials. The falling liquid column is formed by flushing water (or other liquid) up though an outer annulus space formed between two concentric shells (preferably cylinders) and allowing the water to cascade down the inner walls of the innermost shell. This forms a liquid flowing down this inner wall. As solid material (typically in finely powdered form) is added to the SLC through a top opening, the solid material will make contact with this falling film and mix with the liquid. There are significant benefits associated this design.

First, it effectively increases the surface area for contact between the solid and the liquid (the wetting surface) far beyond the surface area available if the solid material were simply dropped onto the surface of liquid in a tank. Further, preferred embodiments of the present invention also allow material to be recirculated through the SLC. This allows for an even greater wetting of the solid material and thus more effective blending, which is especially significant for fine, hydrophobic solids.

Additionally, the use of the SLC allows the solid-liquid blending to essentially take place remotely before the process materials reach a process material tank. As the term is used herein, a tank can be any container suitable for holding a large volume of process material. Although some blending or mixing of process materials can take place inside the container, a tank is typically used for holding/storing a volume of liquid or of blended process material. The use of the SLC according to the present invention eliminates the need for a specialized blending tank having a separate solid feeding element. Instead, a solids blending system according to the present invention can make use of multiple process material tanks, with each tank capable of serving as a holding tank for the blended process materials or as a day tank for distribution to the global line. This allows tanks to be used as both blending and distribution tanks successively, thus increasing flexibility.

According to preferred embodiments of the present invention, the actual mixing of solid material with the liquid component can take place in the SLC, rather than in a process material tank. The blending of the solid material and the liquid component thus takes place remotely, that is away from the process material tanks. Unlike the solid material systems of the prior art, according to the present invention solid material is not added to a volume of liquid or liquid process material held in a tank. Instead, as described in greater detail below, solid material is added to the liquid as it is being pumped through the SLC. Thus, as long as the liquid flow rate is sufficiently high, solid material added over a period of time is always being added to a fresh wetting surface.

Because the solid material is being added to the flowing liquid as the solid material is dispensed by the solid feeder, the resulting mixed liquid process material can be easily directed and pumped via conduits/material supply lines to any one of multiple process material tanks. As a result, a single solid feeder can be used with multiple process material tanks. The elimination of separate solid feeders for each tank represents a significant reduction in overall system cost. Because the same solid feeding element can be used to supply solid material to the process material for multiple tanks, the same volumetric feed rate, feed mass flow rate, or dose can be applied to all of them. This negates the need for independent tuning, maintenance of multiple feeders, and reduces batch-to-batch process variability.

A preferred embodiment of a solid-liquid contactor according to the present invention is shown in detail in FIGS. 2A-4. FIGS. 2A-2B show perspective views of a solid liquid contractor; FIG. 3 shows a vertical cross-sectional view of the embodiment shown in FIGS. 2A-2B; and FIG. 4 shows a top down view at the cross section indicated by line "AA" in FIG. 3. Solid-liquid contactor 200 is preferably formed from two concentric shells, the shells preferably being cylindrical in shape. As shown in FIGS. 3-4, the outer diameter of inner cylinder 202 is smaller than the inner diameter of outer cylinder 201. Because inner cylinder 202 is located inside outer cylinder 201, the two cylinders together define an outer fluid volume 208 (the space between the outer cylinder 201 and the inner cylinder 202). Inner cylinder 202 further defines inner blending chamber 209. Persons of skill in the art will recognize that the shells defining inner blending chamber and the outer fluid volume need not be concentric and need not have a circular cross section. In some embodiments, either or both could have a cross section that is, for example, square, rectangular, triangular, or oval. In some preferred embodiments, the cross sections of either or both may not be constant throughout the shell's height. For example, the shell forming inner chamber 209 could be sloped inward toward the base of the inner chamber so that more of an added process material will fall onto the falling liquid column on the chamber walls as described below.

The upper or dorsal lip 211 of inner cylinder is preferably lower than the top 201*a* of outer cylinder 201. As used herein, descriptions referring to the upper or lower portions of the solid-liquid contactor will be described with reference to the orientation shown in FIGS. 2-4 in which solid material is introduced at the top or upper portion and the blended process material flows out of the bottom or lower portion. Dorsal lip 211 is also preferably serrated around the entire lip, the serrations 221 preferably being beveled facing the inner axis of inner cylinder. Serrations 221 create a greater degree of turbulence across the inner column surface and tend to spread or disperse the liquid across the surface of the inner column wall better than a flat lip, especially when the SLC has not been leveled to a high degree of accuracy. The SLC is preferably mounted via mounting plate 217 so that the dorsal lip of the inner cylinder is level across the entire circumference in order to better spread the liquid flow evenly around the interior of the inner cylinder.

Inlet 205*a* can be used to introduce deionized water or other liquid 222 into the solid-liquid contactor. Liquid 222 pumped into the SLC through the inlet 205*a* will enter the outer fluid volume through port 205*b*. As liquid is pumped in through the inlet, it will fill the outer fluid volume 208 until the liquid reaches the top of the dorsal lip of the inner cylinder. The liquid will then spill over and cascade in a fine film down inner surface 210 of inner cylinder 202. Gravity drain 204*a* can be used to drain liquid 224 from the SLC, while atmospheric vent 216 can be used to vent air from the SLC or to supply a desired atmosphere or gas such as humidified nitrogen.

There will preferably be no fluid contact between the outer fluid volume 208 and the inner blending chamber 209 except at the top of the inner cylinder. The liquid that flows down the inner surface of the inner cylinder will preferably pool at the bottom and form a vortex 223 as the liquid is pumped out through opening 218 in discharge port 206. This vortex also serves to further mix the process material. Floor 212 will preferably be conically shaped, sloping downwardly from the inner wall of the internal cylinder to the smaller diameter discharge port, to promote the development of a vortex at the bottom of the inner cylinder, although a variety of pitches or even different shapes (flat, rounded, etc.) could also be used. Capacitive or photoelectric sensors 215, 220 can be used to monitor the pooled liquid level in the outer fluid volume 208 and inner cylinder 209. Persons of skill will recognize that a capacitive sensor as discussed above may only provide a signal indicating whether the pooled liquid has reached a certain level. The use of other sensor types, such as an ultrasonic sensor mounted at the top of the SLC, could give an indication of the liquid level wherever it might be across the entire length of the falling column of liquid in the blending chamber.

Once liquid is flowing through the solid-liquid contactor, solid material can be introduced for blending. In the embodiments of FIGS. 2-4, the top portion of the SLC is covered by lid 203 that includes centered opening 203*a* through which solid material 207 can be introduced. Preferably, solid material is dispensed from a prior art volumetric or loss-in-mass solids feeder (such as the solid feeder described above). The solid material can be gravity-fed through the centered opening 203 into the inner cylinder chamber 209 of the SLC. Some preferred embodiments may include cylinder 213 that can be used to funnel the solid material to the inner cylinder. Lid 203 can be secured by screws 220 or by any other suitable means.

As solid material 207 is dropped through opening 203*a* of lid 203, much of the solid material will contact the falling liquid film that is cascading down the inner surface of the inner cylinder. Some of the material will fall directly into the liquid vortex at the bottom of the cylinder. Both the falling liquid film and the liquid surface of the vortex 223 form a continuously changing contact surface between the liquid and solid, thereby increasing the effective wetting surface area without increasing the dimension of the available static surface area. In other words, while the absolute area of the inside of the inner column does not change, the constant flow of liquid provides a continuously refreshing surface which is equivalent to the solid material being added to a much larger contact surface area. The continuously changing contact surface helps ensure that even fine, relatively hydrophobic solids do not readily form a non-wetting barrier as seen in conventional solids-addition systems with limited surface exposure.

Persons of skill in the art will recognize that adding solid material to the vortex resulting from the liquid being discharged from the tank also produces a continuously changing contact surface that is constantly refreshed by the liquid flowing into the SLC. This is very different from adding liquid to circulating liquid in a prior art blending tank because the liquid in the prior art tank is just being stirred by an agitating device, not replaced by fresh liquid flowing into the tank.

In preferred embodiments of the present invention, the SLC is used in a system that allows the liquid to recirculate to the process material tank and back through the SLC multiple times. Thus, additional solid material can be mixed into a certain bolus of liquid during each recirculation. In this fashion, the amount of blended solid material can be raised gradually, rather than all at once. This helps prevent flow errors or system blockage resulting from solid material clumping or aggregation.

Further, an SLC according to the present invention can be adjusted in a number of different ways to increase the mixing efficiency for the added solid material. First, the flow rate of the falling column of liquid can also be adjusted to increase or decrease the contact surface area and as a result the mixing rate. A higher flow rate is the equivalent of a providing a greater surface area and so the mixing rate will increase, meaning that solid material can be more rapidly introduced into the SLC. Slowing the flow will have the opposite effect.

Also, the rate at which the blended process material is removed through the discharge port 206 in the blending chamber can be used to effectively manipulate the height of the falling column of liquid which will also affect the mixing rate. As described below, the liquid is preferably pulled out of the discharge port and transferred to the process material tank through material supply lines via discharge pump. A slower discharge rate will cause more liquid to pool at the bottom of the blending chamber, raising the level of the liquid and submerging more of the inner wall of the inner cylinder. Thus, changing the discharge rate (or maintaining the discharge rate and changing the liquid flow) can also be used to increase or decrease the static contact surface area by altering the height of the falling liquid column (as distinguished from the actual physical height of the inner cylinder).

In preferred embodiments, these adjustments (including the rate of liquid removal and the rate of fill) can be actively controlled using a feedback mechanism to automatically maintain a steady liquid level in the SLC.

A process control system according to the present invention may include a controller, an input device or sensor, and one or more flow controlling devices. It should be appreciated that valves are discussed herein for controlling flow by way of example only; another type of flow control device may be substituted for any valve in the embodiment shown herein. The controller may be any device capable of receiving information and acting upon the information based upon a series of protocols, such as logic code. For example, the controller may be a microprocessor based device, such as a computer. A sensor, such as a capacitive or photoelectric sensor, can be used to monitor various process valves, such as monitoring the pooled liquid level in the blending chamber, and to provide a signal to a controller (described in greater detail below) based upon the detected values such as the pooled liquid level.

Where the process control system includes one, the input device may be connected to the controller to provide an input signal representing a desired blend of process materials. The input device may be any device capable of receiving information and relaying it to the controller. For example, the input device may be a potentiometer, key pad, or Supervision Control and Data Acquisition (SCADA) node.

The one or more flow controlling devices of the process control system may be connected to one or more material supply lines and to the controller, and the signal received by the controller can be used as a gating element for process control of the SLC. According to a preferred embodiment of the present invention, the pooled liquid level can be automatically adjusted based upon the amount of liquid entering the SLC and the amount leaving. In order to control the precise level, the controller can automatically control the operation of one or more flow control devices to change the rate of flow into the SLC or the discharge rate, or both. By flow control device, it is meant any device that is able to provide a desired level of flow control, such as various types of valves, pumps and other pressure/flow modifying devices.

Figure 5:
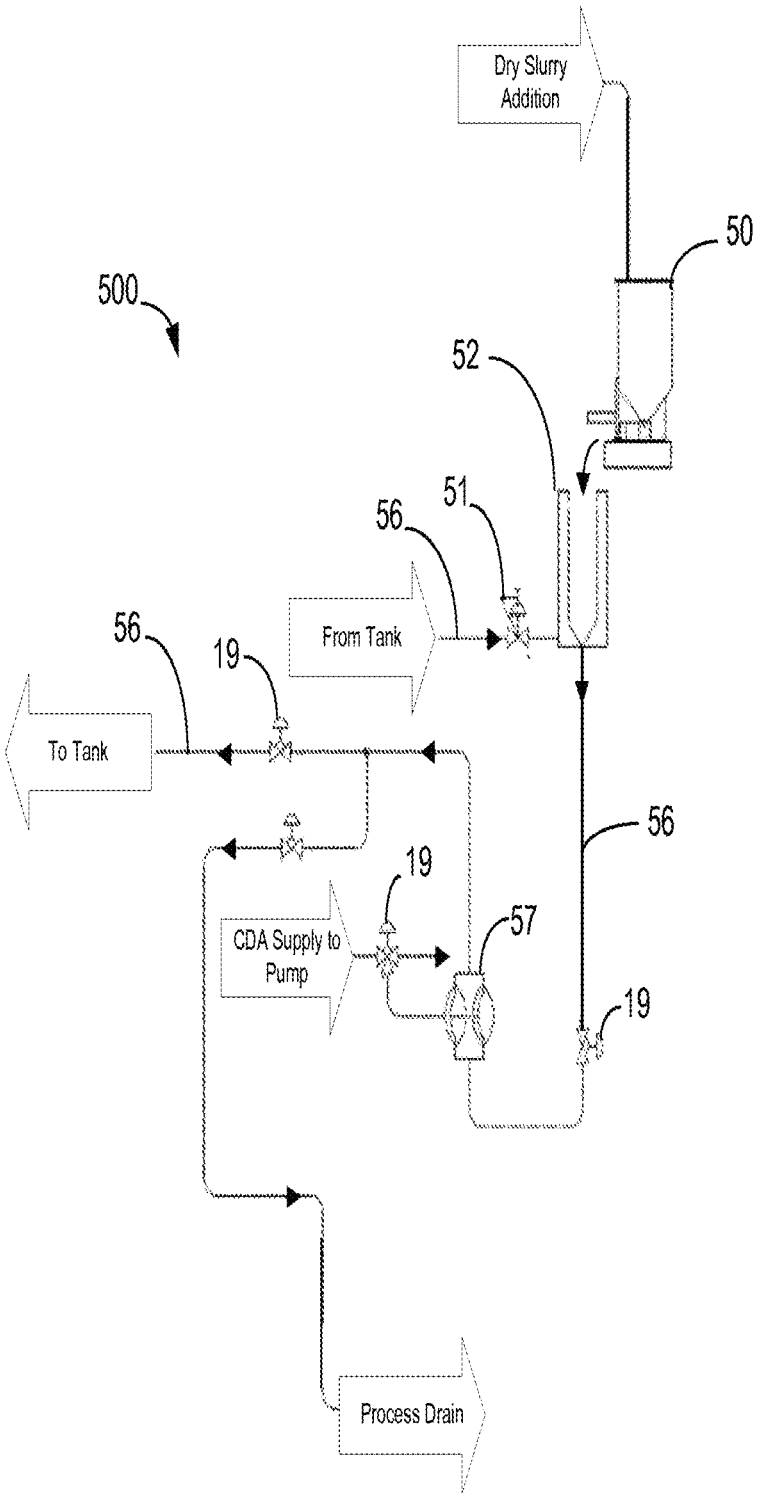
FIG. 5 shows the solids delivery subsystem of a bulk delivery system using a single blending/distribution tank according to a preferred embodiment of the present invention.
Figure 6:
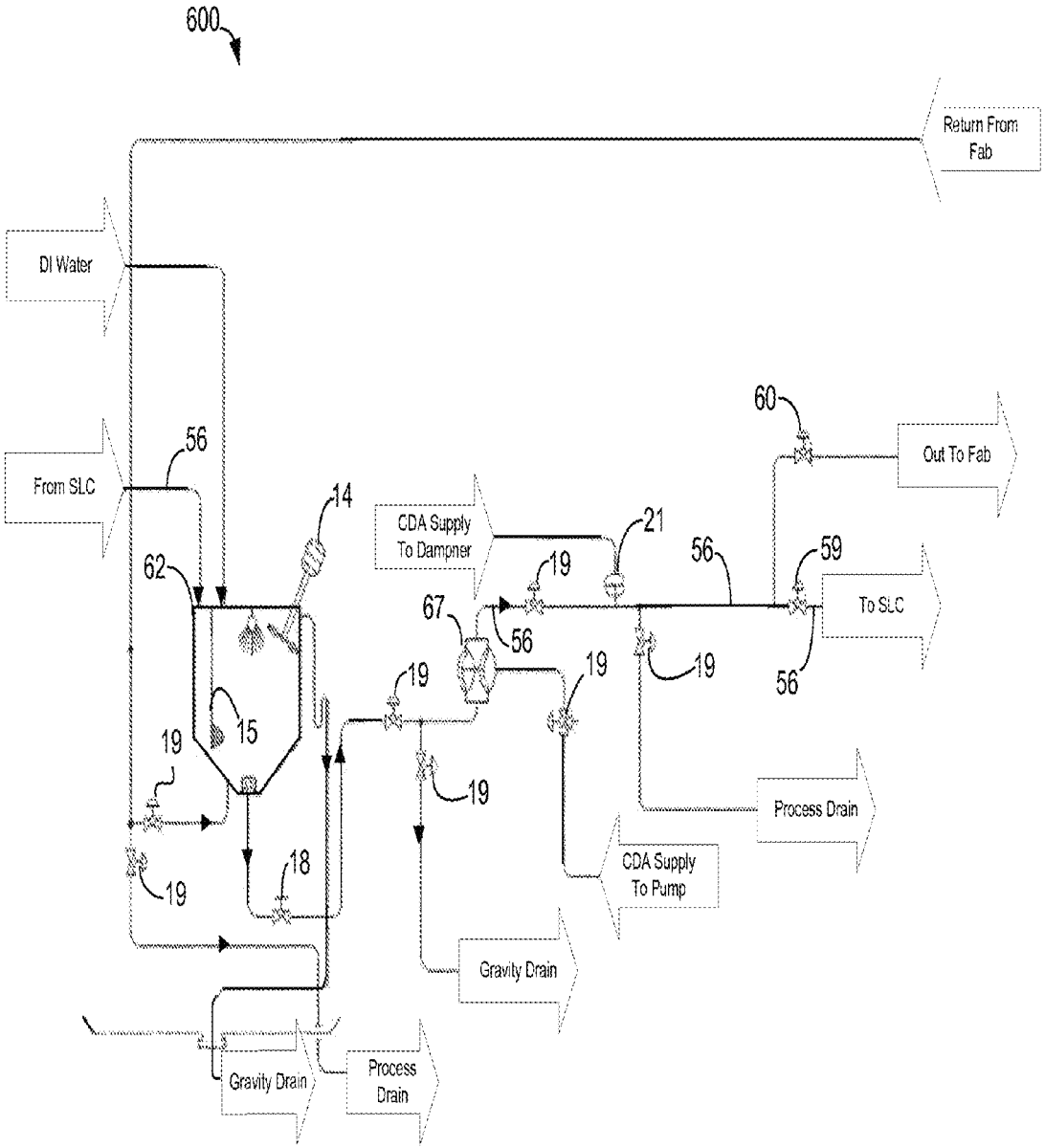
FIG. 6 shows the blending/distribution subsystem of the bulk delivery system of FIG. 5.

FIGS. 5 and 6 illustrate a bulk delivery system including a solids delivery subsystem 500 (FIG. 5) and a blending/distribution subsystem 600 (FIG. 6) using a single blending/distribution tank according to a preferred embodiment of the present invention. Such a bulk delivery system preferably includes a solid feeder 50 (volumetric, loss-in-mass), process material tank 62 (for both blending and distribution), solid-liquid contactor (SLC) 52, a plurality of material supply lines, supporting flow regulation, one or more level detection devices, pumping equipment, and a process control system. The plurality of material supply lines may be any suitable conduits for carrying process materials. For example, material supply lines may be pipes, channels, or other devices for directing fluid flow. The plurality of material supply lines may supply many different process materials from a variety of sources. For example, material supply lines may supply process materials from storage containers or from facility generation plants. In some instances, the material supply lines may supply process materials from a dispensing subsystem.

In order to blend and distribute the desired process material, a liquid (such as DI water) is initially added to process material tank 62. The quantity of liquid added can be monitored, for example, with a scale, flow meter, or level sensing device. Liquid is then pumped through the local loop material transfer lines 56 to the solids delivery subsystem 500 via distribution pump. This pump can be used both to pump liquid process material through the local loop for blending and to the global loop for distribution, depending upon the operation of automatic valves 59 and 60. The pumps used in the bulk delivery system of FIGS. 5 and 6 may be centrifugal or positive displacement pumps 57, 67. Where appropriate, a pulsation dampener 21 may be employed to smooth the pressure in the lines resulting from one of the pumps.

Referring also to FIG. 4, liquid pumped to the solids delivery subsystem 500 preferably enters an SLC (such as the embodiment described above) through an inlet (such as inlet 205*a*) so that it fills outer fluid volume 208 and cascades in a fine film down inner surface 210 of inner cylinder 202. The flow rate of liquid entering the outer fluid volume of the SLC is manipulated with a flow controlling device 51, which controls or maintains the liquid flow to the SLC at a set flow rate or pressure. Flow controlling device may be a flow controller, a flow regulator, or a pressure regulator, depending in part upon the type of pump used to pump liquid to the SLC. For a positive displacement pump, such as a dual diaphragm pump, it may be desirable to use a flow regulator. Where pump 67 is a centrifugal pump, a pressure regulator could be used.

For most operations, the level of liquid in the SLC should be maintained so that the pool and vortex at the bottom of the inner cylinder blending chamber are relatively small. This results in the height of the falling fluid column being high enough to expose the maximum solid-liquid contact area. The liquid levels in the blending chamber can be controlled using a variety of mechanisms. For example, the local loop/dispense pump pressure can be adjusted and the local loop supply pressure regulator/flow controller modulated to automatically maintain a liquid level in the SLC circuit based on a fixed local loop dispense pump flow rate. Although more difficult because two values are being adjusted at once, this technique is useful for multi-tank systems (described below) where the system will not be simultaneously dispensing when circulating the local loop. Alternatively, the local loop/dispense pump pressure can be fixed, and the flow or pressure regulator flow rate modulated to maintain a desired liquid level in the blending chamber. In some preferred embodiments, both the local loop supply and return circuits can be manually tuned based on dispensed and required blend rate parameters. This technique allows for a lower cost alternative to the previous approaches as pneumatic or electronic control devices are unnecessary.

Once the appropriate liquid level in the blending chamber has been achieved, solid material can be added for blending. Solid feeder 10 holds a supply of dry solid material. The solid material is typically moved from the solid feeding element to blending tank 12 by using a feed screw mechanism as described above. The amount of solid material added can be precisely controlled, for example, using a sold feeder having a loss-in-weight mechanism such as the K-tron Soder K-CL-24-KT20 dual screw feeder having a reported solids delivery error of +/−0.03% of a full scale maximum 60 kg mass. Typically, the solid material will be added gradually over a period of time as the feed screw turns to force material out of the feeder.

Liquid is preferably circulated from the blend/distribution tank through the local loop at least until all solid material has been added. In a single blend/distribution tank and single solid feeder system, the local circulation loop through the SLC can preferably maintain recirculation while process material is also being distributed to the global loop. This functionality negates the need to flush and purge the local circulation loop between batches and prevents the resulting loss of process material.

Figure 7:
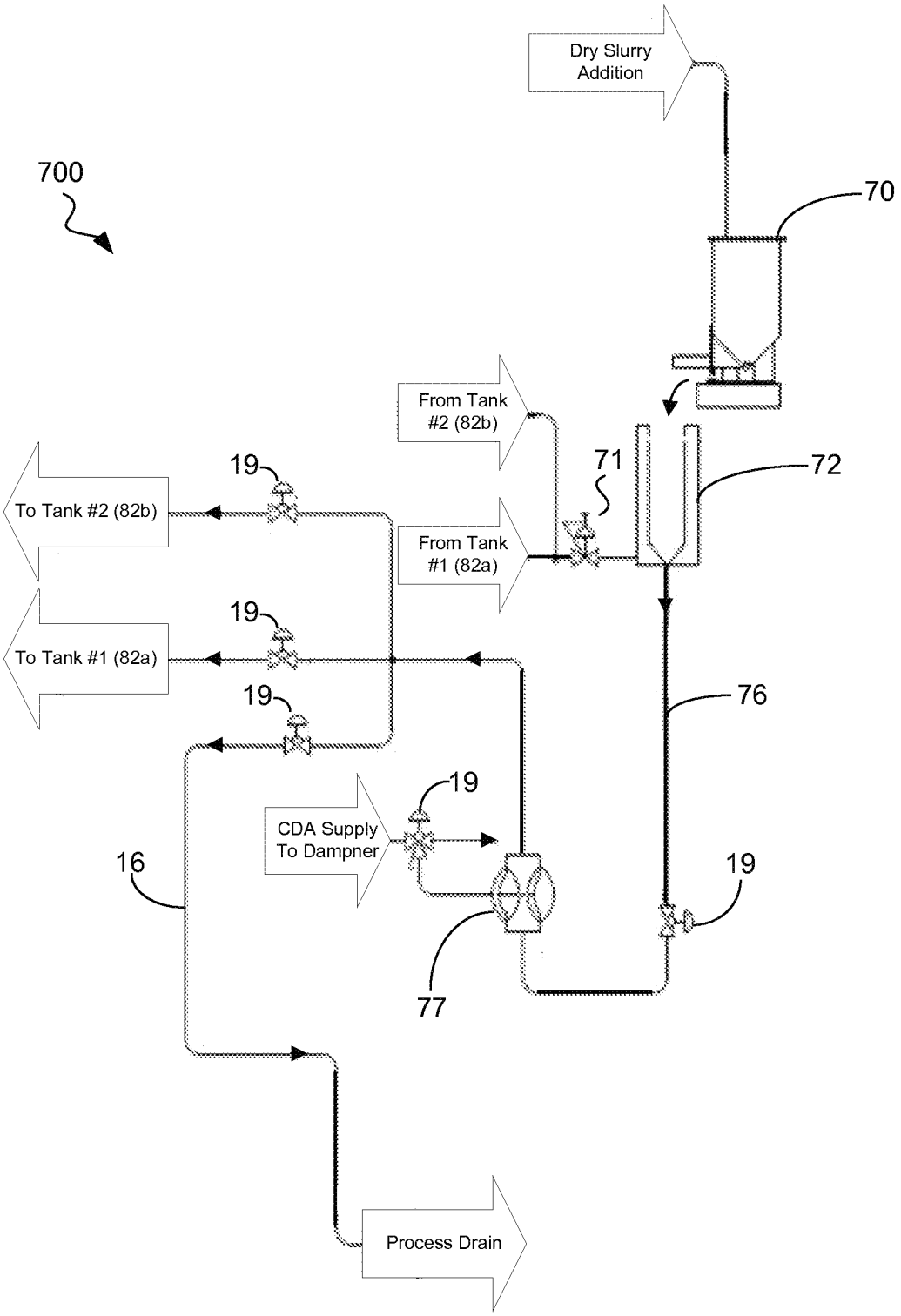
FIG. 7 shows the solids delivery subsystem of a bulk delivery system using two blending/distribution tanks according to a preferred embodiment of the present invention.
Figure 8:
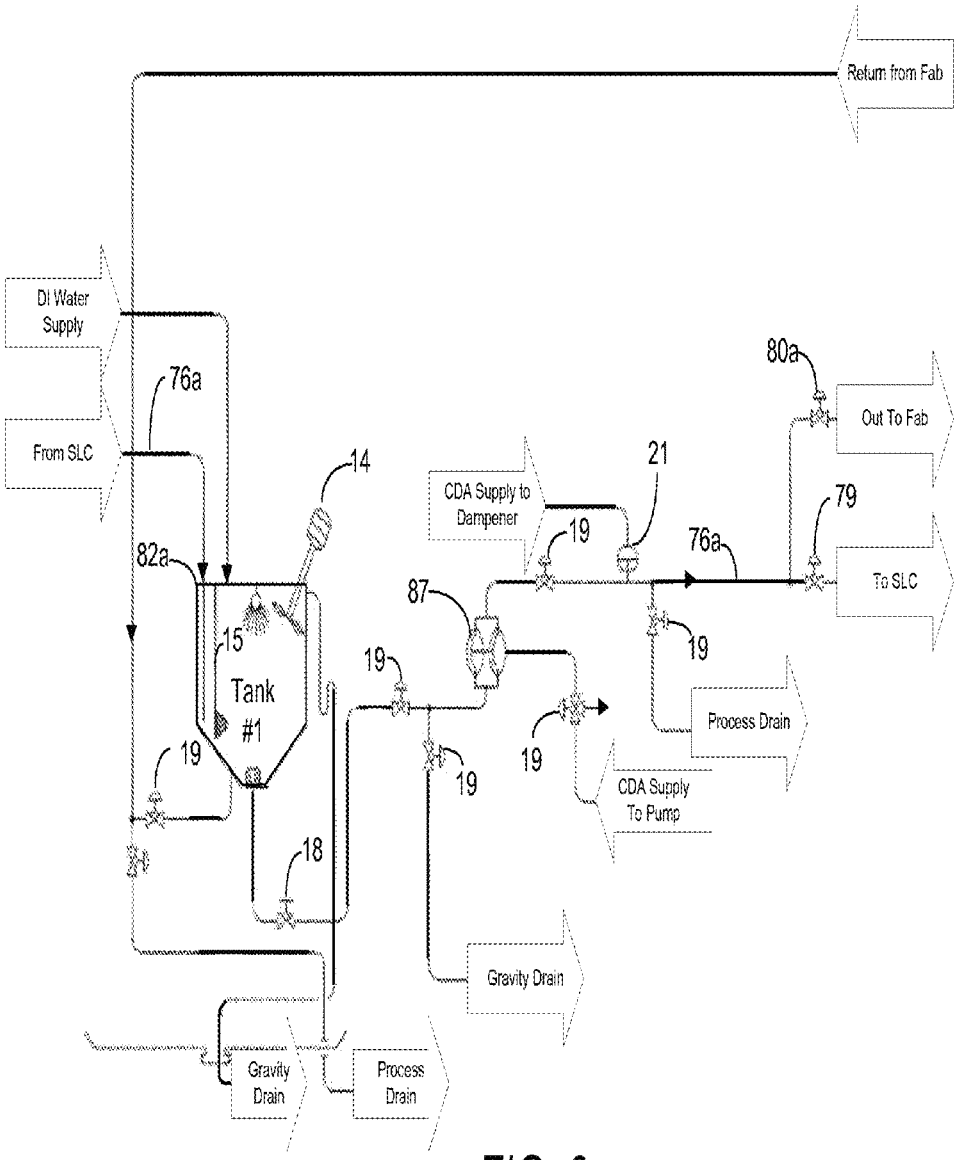
FIG. 8 shows the blending/distribution subsystem for the first blending/distribution tank of the bulk delivery system of FIG. 7.
Figure 9:
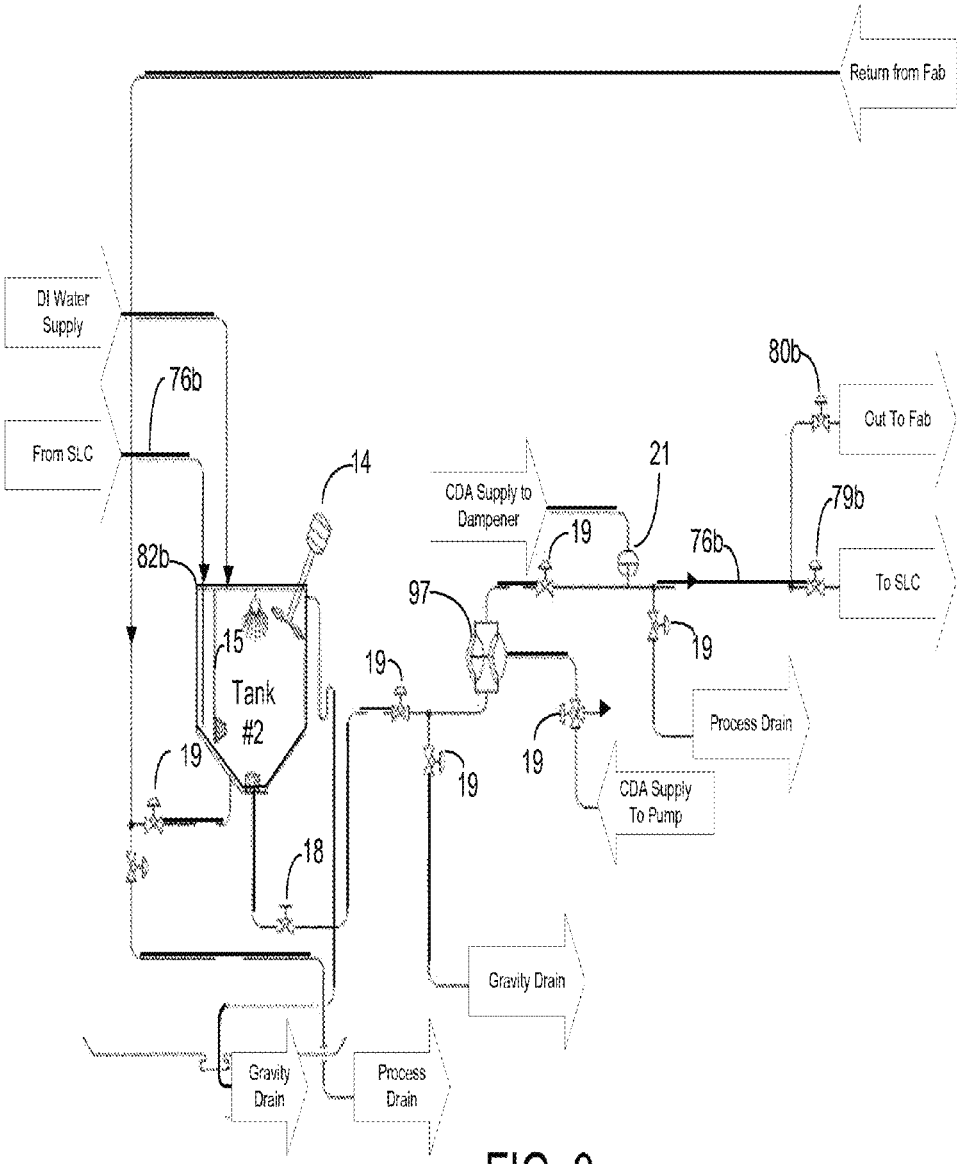
FIG. 9 shows the blending/distribution subsystem for the second blending/distribution tank of the bulk delivery system of FIG. 7.

Preferred embodiments of the present invention are especially suited for use with multiple blending/distribution tanks such as the multiple tank bulk delivery system shown in FIGS. 7-9. In the embodiment shown in FIGS. 7-9, the blending/distribution tanks are operated in parallel. As in the single tank system of FIGS. 5-6, liquid is added to blending/distribution tanks 82*a* and 82*b* and then pumped through the local loop material transfer lines 76*a* and 76*b* to the solids delivery subsystem 700 via distribution pumps 87 and 97. As shown in FIG. 7, the liquid circulation from blending/distribution tanks 82*a* and 82*b* is combined at a common junction and then pumped to a single SLC. The distribution sub-systems of both tanks feed to a common junction and then to the global loop.

The flow rate of liquid entering the SLC from the combined circulation from tanks 82*a* and 82*b* is manipulated with a flow controller/regulator 79, which controls or maintains the liquid flow to the SLC at a set flow rate or pressure. The SLC is then operated and controlled exactly as described above for a single tank system. The significant difference is that the SLC is distributing blended process fluid to two separate tanks. In other preferred embodiments, more than two blending/ distribution tanks could be serviced by the same SLC.

Figure 1A:
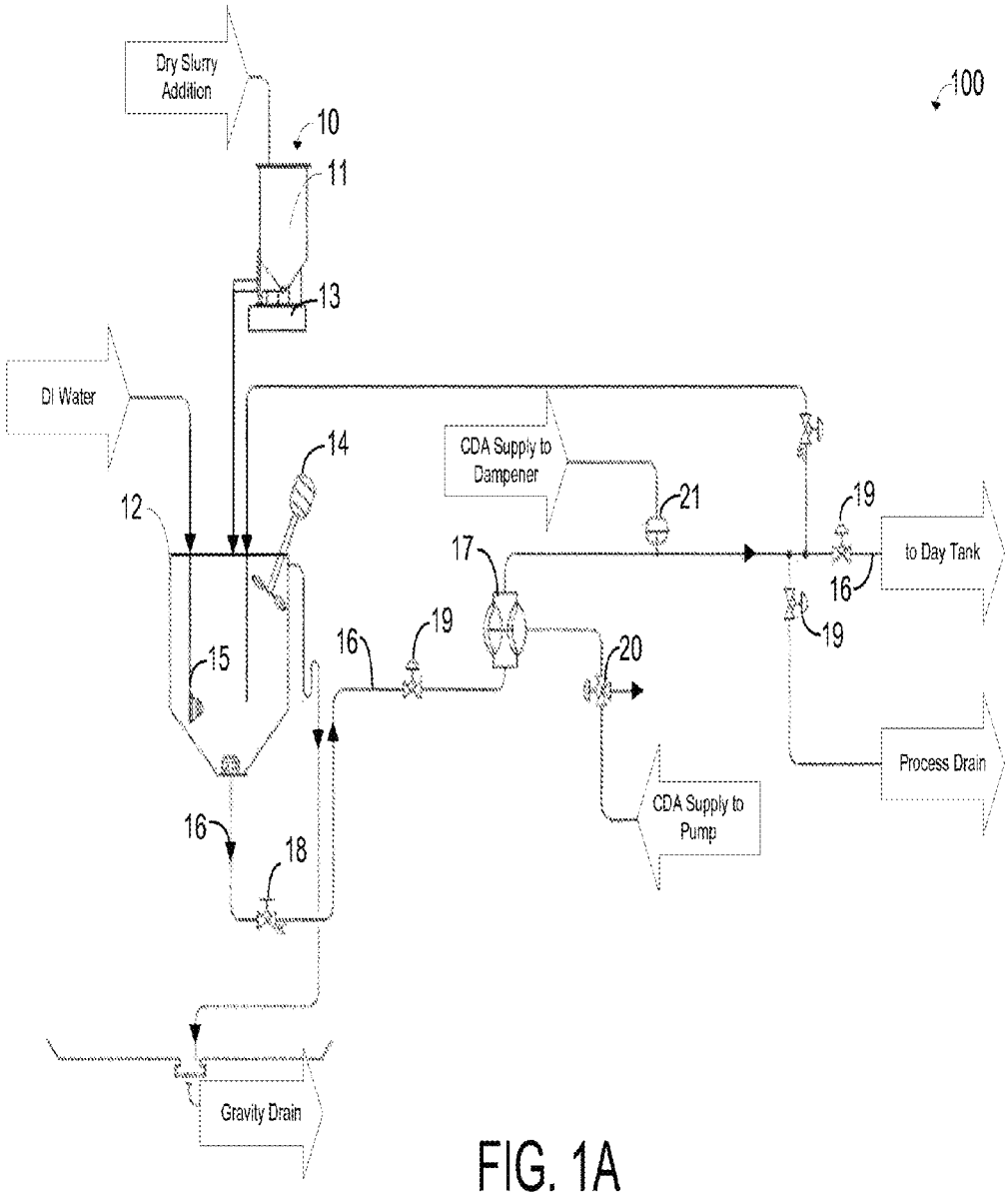
FIG. 1A Prior Art
FIG. 1A shows a typical prior art arrangement of a solids blending subsystem for mixing a process material.
Figure 1B:
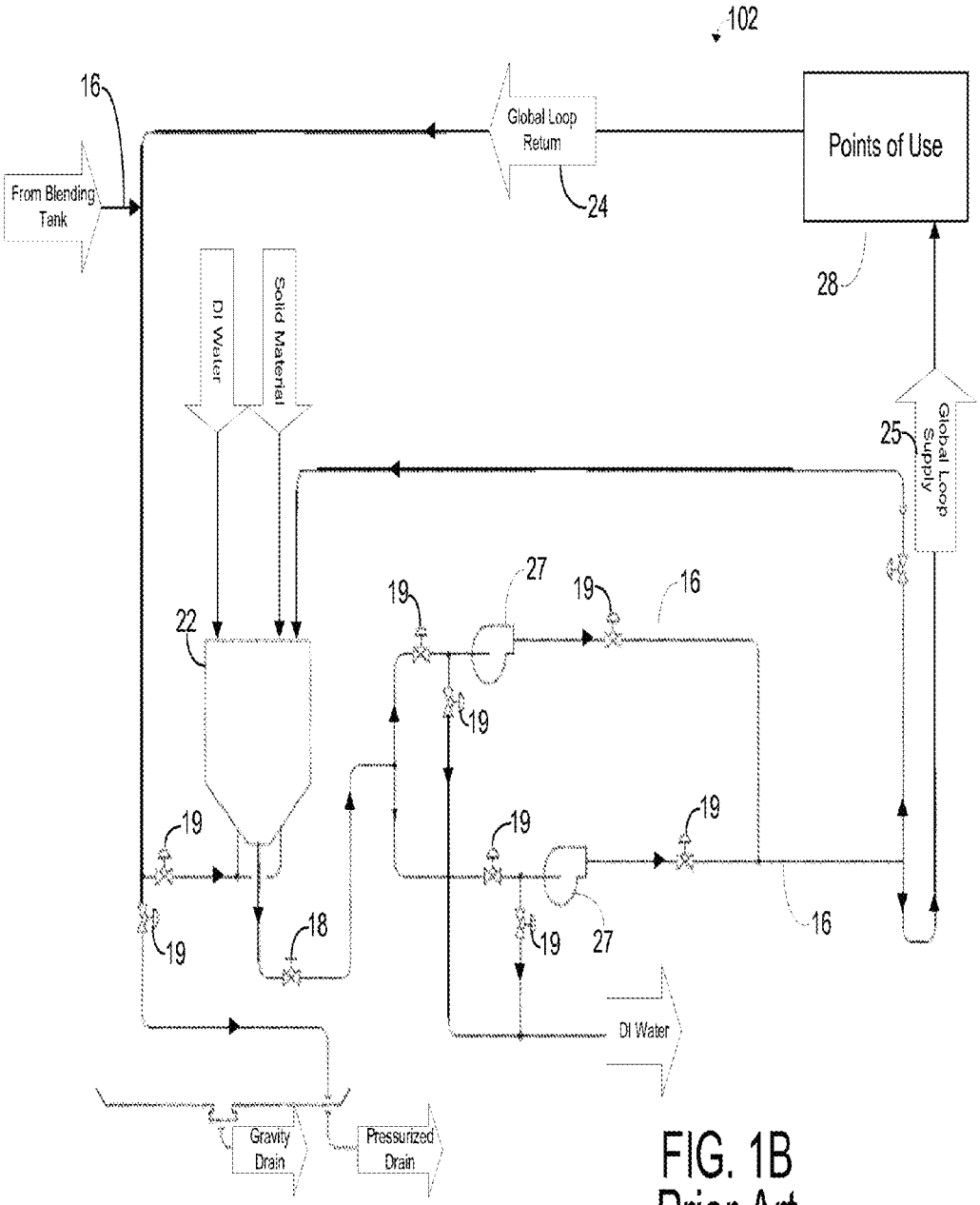
FIG. 1B Prior Art
FIG. 1B shows a typical prior art arrangement of a distribution subsystem distributing blended process materials.

The parallel arrangement of the blending/distribution tanks shown in FIGS. 7-9 offers a number of advantages over the serial arrangement of the prior art as shown in FIGS. 1A and 1B. As described above, the use of an SLC 72 according to the present invention allows multiple tanks to be supplied by one solid feeder 70, thus reducing overall system costs. In addition, because the same solid feeder is used for multiple tanks, the same volumetric feed rate, feed mass flow rate, or dose can be applied to all of them. This negates the need for independent tuning, maintenance of multiple feeders, and reduces batch-to-batch variability.

Also, using the serial arrangement of the prior art, a significant amount of time is required to transfer process materials from the blending tank to the distribution tank. Time is also lost in the circulation of process materials within the blending tank to ensure that the process materials have been fully blended. In contrast, the parallel arrangement allowed by the present invention allows both tanks to be used as blending and distribution tanks. In other words, when one tank is being used in the blending process, the other can be used to distribute process materials, and vice versa.

In another preferred embodiment of the present invention, the SLC as described above could be used in a system having two or more blending tanks arranged in parallel and a separate distribution tank arranged in series and fed by both blending tanks. Such a system could be employed, for example, when an additional blending tank needs to be added to a prior art serial two tank distribution system. Rather than adding a second blending tank with its own solid feeder, an SLC according to the present invention could be used to supply blended process material to both blending tanks using only one solid feeder. By alternating the blending in the two tanks—and adjusting the valves in the material supply lines—the same solids feeder could be also used to feed the two tanks separately rather than simultaneously as described above.

According to preferred embodiments of the present invention, various metrology devices can be employed for closed loop feedback control of process solids content. Suitable metrology devices could include, for example, densitometers, chemical concentration analyzers, and solids concentration/size class monitoring devices. As is known in the prior art, metrology devices can be placed on the local or global loop supply circuits in either an in-line or slipstream configuration such that they can be used for qualification of initial blend character and/or monitoring of the dispensed liquid process material. When necessary, solid and liquid components can be automatically spiked into the system to maintain solid concentration to within an upper and lower control limit. Solids can be added to the blending chamber of an SLC device as described above, and liquids can be added to the blending and/or distribution tank(s) using flow meters or other suitable metering devices. For systems with multiple tanks, an automated queue can be used to categorize the dosing hierarchy between systems in active blend or distribution modes of operation based on operator input.

By using a solid liquid contactor according to the present invention, additional solid material can be easily added to the process material in multiple tanks even after distribution to the global line has begun. For example, if a sensor sends the controller a signal indicating that a value such as specific gravity has fallen below a set point, the controller can use automatic valves positioned along the material supply lines to also begin circulating process materials from a blending/distribution tank through the SLC without interrupting distribution to global line. The controller can then cause the solid feeder to add more solid material to the circulating process material until the measured value is raised to an acceptable level.

Preferred embodiments of the system are thus capable of supplying a desired blend of process materials based on a user specified input. This blend of process materials may be supplied on a continuous basis, without interruption. Additionally, the blended process materials may be supplied on an as-needed basis, eliminating the need to store the blended process materials. In some preferred embodiments, the controller may receive additional input to aid the blending/distribution process. For example, the controller may be supplied with information from process appropriate sensors regarding the process materials or process conditions. Such sensors may be located anywhere in the blending system, such as in the solids delivery subsystem, on a material supply line, or on the local or global process material loops. It will also be recognized that the controller may also control other aspects of the blending/distribution process. For example, the controller may be connected to devices or systems for modifying the properties of the process materials, and may selectively operate these devices or systems based on input received from sensors regarding the condition of the process materials or from an operator or other outside source.

The present invention is adaptable for use in a wide variety of applications. The embodiment of the invention may vary depending on the application. For example, where monitoring of the qualification of process materials is desired, sensors may be used, and these sensors may vary with the process materials. Similarly, the construction of the bulk delivery system, such as piping, tubing, and wetted surfaces of instruments and pumps may be adapted to particular process materials. For example, where such process materials may be abrasive or corrosive, such as the polishing slurries and chemicals often employed in the semiconductor industry, these structures may be formed of plastic materials such as fluoropolymers.

A preferred method or apparatus of the present invention has many novel aspects, and because the invention can be embodied in different methods or apparatuses for different purposes, not every aspect need be present in every embodiment. Moreover, many of the aspects of the described embodiments may be separately patentable.

As used herein, the term "blending" is used to refer to the mixing of solid and liquid components, as well as the addition of the constituent components and the qualification of the resulting batch. The term "process material" or "process materials" is used to refer to the blended solid or liquid, whether or not the addition of solid material has been completed and the batch qualified for distribution. When used in relation to the SLC, the term "liquid" is used to refer to any fluid material capable of being transported through a conduit, whether an original unblended liquid component or the liquid component containing some amount of blended solid material. For example, a liquid may include water, various chemicals, solutions, suspensions of solids, slurries or any such other materials.

Although much of the previous description is directed at the blending and distribution of a slurry formed from a dry powder and DI water, preferred embodiments of the present invention could be applied to any process requiring blended process materials where at least one of the components is a liquid, including a process where two liquid components are added together. In that case, the solid feeder could be replaced by a component suitable for adding a precisely metered volume of one of the liquids. The present invention is particularly applicable to a process requiring the blending of ultra high purity chemicals and abrasive slurries or any other blending applications where accuracy and precision are desired. For example, the present invention is particularly useful in the semiconductor, cosmetic and pharmaceutical industries.

Further, whenever the terms "automatic," "automated," or similar terms are used herein, those terms will be understood to include manual initiation of the automatic or automated process or step. In the previous discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning The accompanying drawings are intended to aid in understanding the present invention and, unless otherwise indicated, are not drawn to scale.

Although embodiments of the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A method of blending a solid material with a liquid material, comprising:

providing a blending apparatus comprising:

an inner shell and an outer shell, the inner shell located inside the outer shell and having an upper lip, the inner shell defining an interior volume, and the space between the inner shell and the outer shell defining an outer fluid volume, a top of the outer shell extending above a top of the inner shell so that material overflowing the outer fluid volume between the shells will flow over the upper lip and into the interior volume of the inner shell;

an inlet port through which the liquid material can be introduced into the outer fluid volume between the shells;

a discharge port at the bottom of the inner volume; and wherein the upper lip of the inner shell comprises serrations and the serrations are beveled facing an inner axis of the inner shell;

filling the outer fluid volume between the shells with a flowing liquid that fills the outer fluid volume between the shells and flows over the upper lip on the top of the inner shell forming a column of liquid flowing down an inner wall of the inner shell and into the interior volume of the inner shell;

providing the solid material into the interior volume of the inner shell to produce a mixture of the solid material with the liquid material in the interior volume;

continually draining the mixture from the interior volume of the inner shell as additional flowing liquid flows from the outer fluid volume, over the top of the inner shell, and into the interior volume of the inner shell and as the solid material is provided to the interior volume to provide a continuous input of liquid and solid and a continuous output of the mixture.

2. The method of claim 1 in which the inner shell and the outer shell comprise concentric cylinders.

3. The method of claim 1 in which mixed materials leave the interior volume of the inner shell at the same rate at which unmixed material enters the interior volume.

4. The method of claim 2, in which filling the outer fluid volume between the inner shell and outer shell with a flowing liquid that flows over the upper lip on the top of the inner shell includes filling the outer fluid volume between the shells with a flowing liquid that flows over the top of the inner shell and forms a film of falling liquid on the inner wall of the inner shell.

5. The method of claim 1, further comprising:

causing the mixture to flow out of the blending apparatus and into at least one tank.

6. The method of claim 5 in which causing the mixture to flow into at least one tank for storage includes causing the mixture to flow into multiple tanks.

7. A method for blending solid material and liquid in a bulk delivery system, comprising:

providing a blending apparatus comprising:

an outer shell; and an inner shell defining a blending chamber and having an upper lip, the upper lip comprising serrations and the serrations being beveled facing an inner axis of the inner shell;

creating a continuous cascade of the liquid down a wall of the blending chamber by passing the liquid through the serrations; and introducing the solid material to the blending apparatus so that at least a portion of the solid material falls onto the continuous cascade of liquid.

8. The method of claim 7, wherein creating a continuous cascade includes evenly spreading the liquid across the wall.

9. The method of claim 7, further comprising:

forming a pool of liquid at the bottom of the blending chamber;

pumping the liquid out from the bottom of the blending chamber, and forming a vortex in the pool of liquid as it is pumped out.

10. The method of claim 9 in which introducing the solid material to the blending apparatus so that at least a portion of the solid material falls onto the continuous cascade of liquid comprises introducing the solid material to the blending apparatus so that at least a portion of the solid material falls onto the continuous cascade of liquid and a portion falls into the vortex in the pool of liquid.

11. The method of claim 9, further comprising:

adjusting a blending rate for the solid material and liquid by adjusting the rate of liquid flow down the wall of the blending chamber.

* * * * *